US005315160A

United States Patent [19]

Chang

[11] Patent Number: 5,315,160

[45] Date of Patent: May 24, 1994

[54] SEQUENTIALLY SHIFTING CONTROL CIRCUIT FOR EXTENDIBLE LIGHT STRINGS

[76] Inventor: Ming Cheng Chang, No. 10, Alley 48, Lane 5, Sheng li St., Yung Kang Hsiang, Tainan Hsien, Taiwan

[21] Appl. No.: 851,998

[22] Filed: Mar. 13, 1992

[51] Int. Cl.[5] ..... H05B 37/00; H05B 39/09; H05B 41/36

[52] U.S. Cl. ..... 307/41; 307/157; 315/185 S; 315/323; 315/360

[58] Field of Search ..... 307/157, 41, 29, 36, 307/38; 315/323, 250, 315, 316, 185 S, 360; 340/478, 331, 792, 768

[56] References Cited

U.S. PATENT DOCUMENTS

| | | | |
|---|---|---|---|
| 4,780,621 | 10/1988 | Bartleucci et al. | 307/38 |
| 4,862,012 | 8/1989 | Mardon | 307/38 |
| 5,027,037 | 6/1991 | Wei | 315/323 |
| 5,192,895 | 3/1993 | Chang | 315/250 |

*Primary Examiner*—A. D. Pellinen
*Assistant Examiner*—Richard T. Elms
*Attorney, Agent, or Firm*—Merchant, Gould, Smith, Edell, Welter & Schmidt

[57] ABSTRACT

A sequentially shifting control circuit for extendible light strings which includes a main controller in one end, a backward signal-generating circuit in the other end and a plurality of bidirectional shifting control units therebetween. Each bidirectional shifting control unit has a plurality of lights connected thereto, thereby constituting and enabling an extendible light string to be sequentially flashed in a forward direction or a backward direction or in both directions simultaneously. Only three conductive lines are required: one for positive power, one for ground, and one for transmitting different control signals which are represented and distinguished by different voltage ranges, voltage levels, and waveform periods, and are mixed together according to a same signal (synchronous signal) to transmit.

6 Claims, 10 Drawing Sheets

SEQUENTIALLY SHIFTING CONTROL CIRCUIT FOR EXTENDIBLE LIGHT STRINGS

BACKGROUND OF THE INVENTION

The present invention relates to a sequentially shifting control circuit for extendible light strings which includes a main controller in one end, a backward signal-generating circuit in the other end and a plurality of bidirectional shifting control units therebetween.

A conventional light string is controlled by a control circuit which has a plurality of output terminals which are each connected to a light string unit, respectively, thereby controlling the flashing of each light string unit sequentially. However, restricted to the limited number of output terminals of the control circuit, the number of the light string units is limited and not extendible.

FIG. 2 shows a conventional sequentially flashing light string which has a main controller 50 and a plurality of shifting units 51, each of which has a plurality of lamps (lights), such that when the main controller 50 sends out shifting control signals, the shifting units 51 sequentially shifts the shifting control signals forward or backward and enables the lamps bulbs to sequentially twinkle forward or backward.

However, for the purpose of forward shifting and backward shifting, the conventional light string requires a forward (right) shifting line 2A, a backward (left) shifting line 2B, a synchronous line 2C, a forward-/backward selection line 2D, a backward data input line 2E, two power lines 2F (positive power), and 2G (ground). The forward shifting line 2A and the backward shifting line 2B are used to carry required shifting signals. The synchronous line 2C provides required synchronous signal. The forward/backward selection line 2D sets an action mode for each shifting unit 51. The backward data input line 2E is controlled by the main controller 50 to send backward data to a last shifting unit 51.

SUMMARY OF THE INVENTION

The sequentially shifting control circuit for extendible light strings in accordance with the present invention comprises a main controller in one end, a backward signal-generating circuit in the other end, and a plurality of bidirectional shifting control units therebetween. Each bidirectional shifting control unit has a plurality of lights connected thereto, thereby constituting and enabling an extendible light string to be sequentially flashed in a forward direction or a backward direction or in both directions simultaneously. Only three conductive lines are required: one for positive power, one for ground, and one for transmitting different control signals which are represented and distinguished by different voltage ranges, voltage levels, and waveform periods, and are mixed together according to a same signal (synchronous signal) to transmit.

It is an object of the present invention to provide a sequentially-shifting control circuit for an extendible light string which requires a single control signal line.

It is another object of the present invention to provide a sequentially-shifting control circuit for an extendible light string where each bidirectional shifting control unit comprises two sets of independent shifting circuits and synchronous circuits, thereby enabling the light string to do forward or backward shifting in respective ends thereof or even do bidirectional shifting simultaneously.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
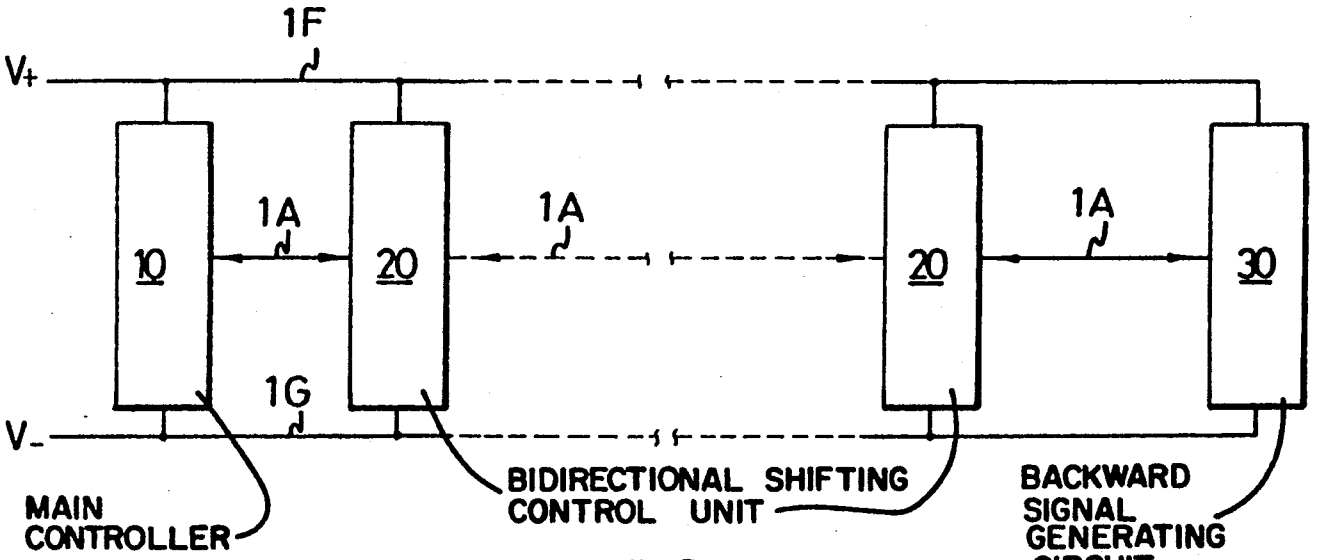
FIG. 1 is a block diagram of the circuit in accordance with the present invention.
Figure 2:
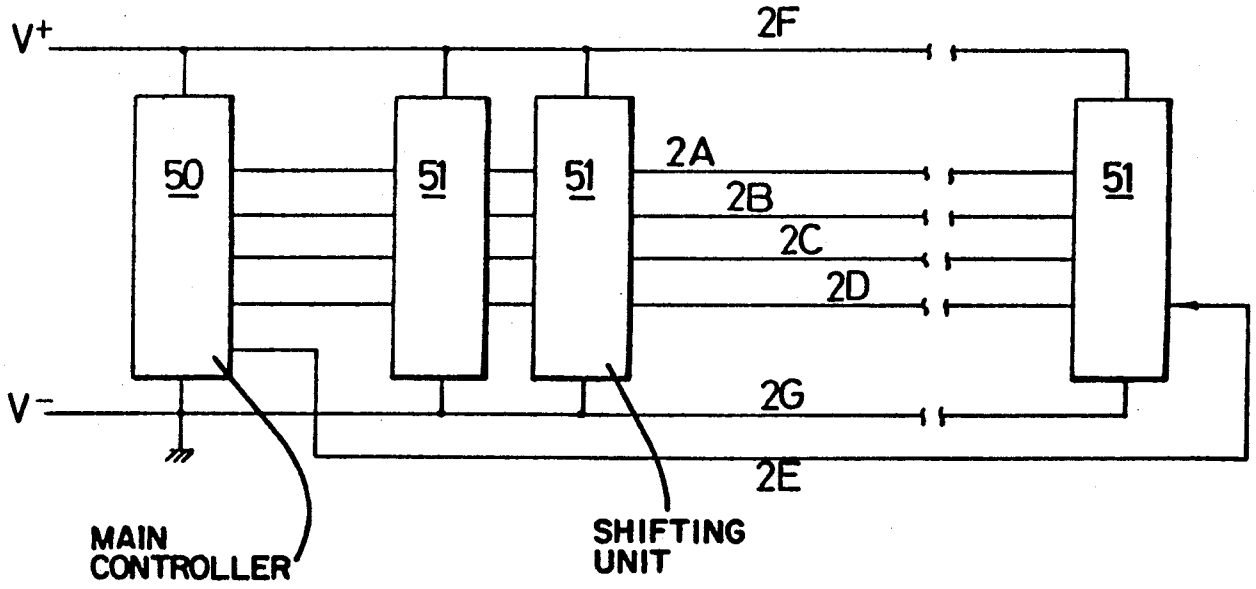
FIG. 2 PRIOR ART
FIG. 2 is a schematic diagram of a conventional light string control circuit.

Referring to FIG. 1, the sequentially shifting control circuit for extendible light string comprises a main controller 10 and a backward signal generating circuit 30 in respective ends thereof and a positive power line 1F, a ground line 1G, and a signal line 1A connected therebetween to serially couple a plurality of bidirectional-shifting control units 20.

Figure 4:
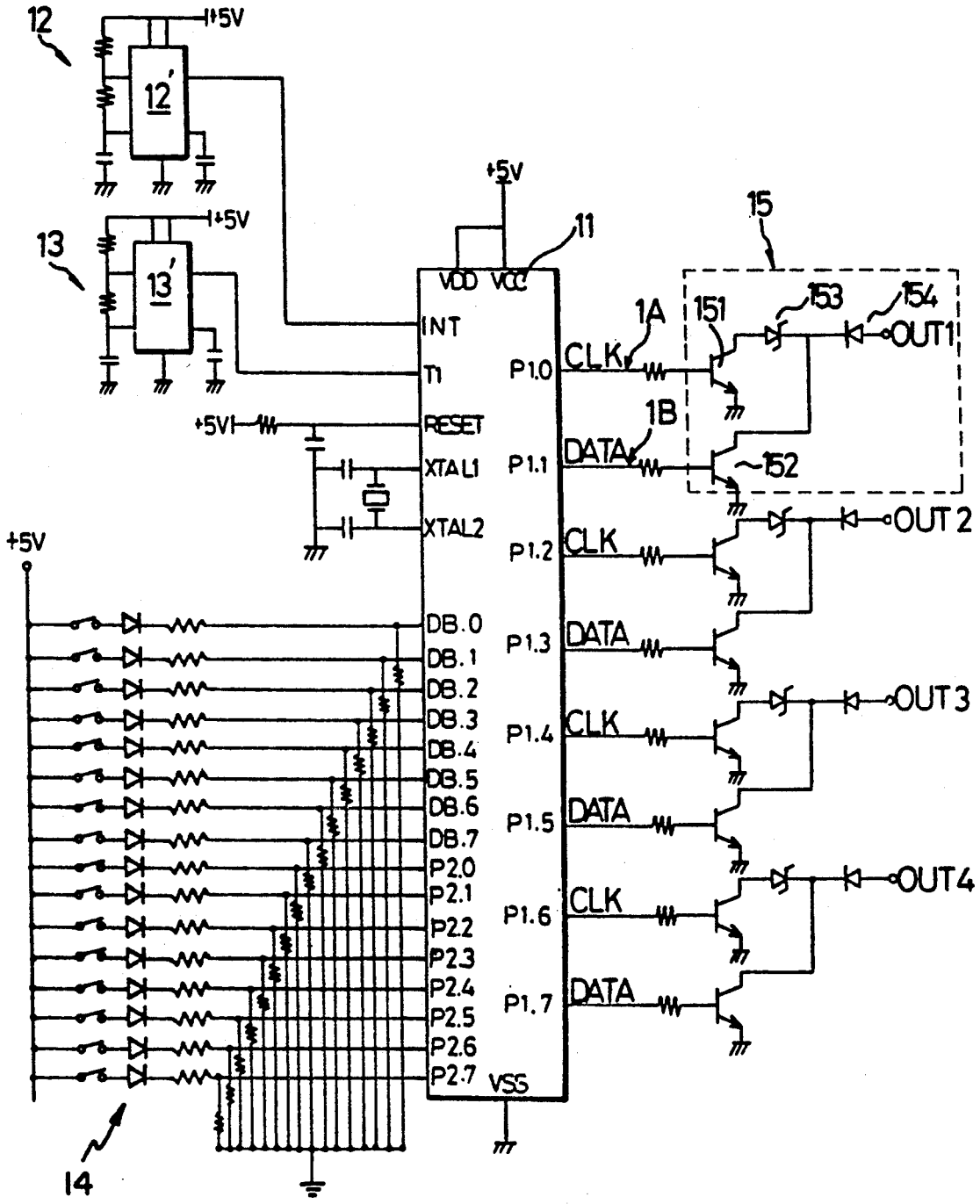
FIG. 4 is circuit diagram of the main controller.

Referring to FIG. 4, the main controller 10 comprises a single chip microcomputer 11, a clock generator 12, a data clock generator 13, an input selecting means 14, and a plurality of driving means 15 connected to output terminals of the microcomputer 11. The microcomputer can use an Intel-manufactured microcontroller 8049. The input selecting means 14 provides sixteen input selections. A first clock generator 12 provides a clock signal in an INT terminal of the microcomputer 11. A data generator 13 provides a data clock signal in a T1 input terminal of the microcomputer 11. The first clock generator 12 and the data clock generator 13 respectively comprise a commercial timer 555 as labeled with 12' and 13'. Four sets of driving circuits 15 are connected to output terminals P1.0 to P1.7 of the microcomputer 11. Each of the terminals P1.0, P1.2, P1.4, and P1.6 of the microcomputer 11 outputs a clock signal for the clock signal of the following bidirectional-shifting control unit 20. Each of the terminals P1.1, P1.3, P1.5, and P1.7 of the microcomputer 11 outputs a data signal for driving the light string, which will be described later. The clock signal and the data signal are mixed via transistors 151 and 152. A collector of the transistor 151 is connected to a Zener diode 153 to limit the clock signal to be in the range between 18 and 5 volts.

Figures 3A, 3B, 3C, 3D, 3E, 3F:
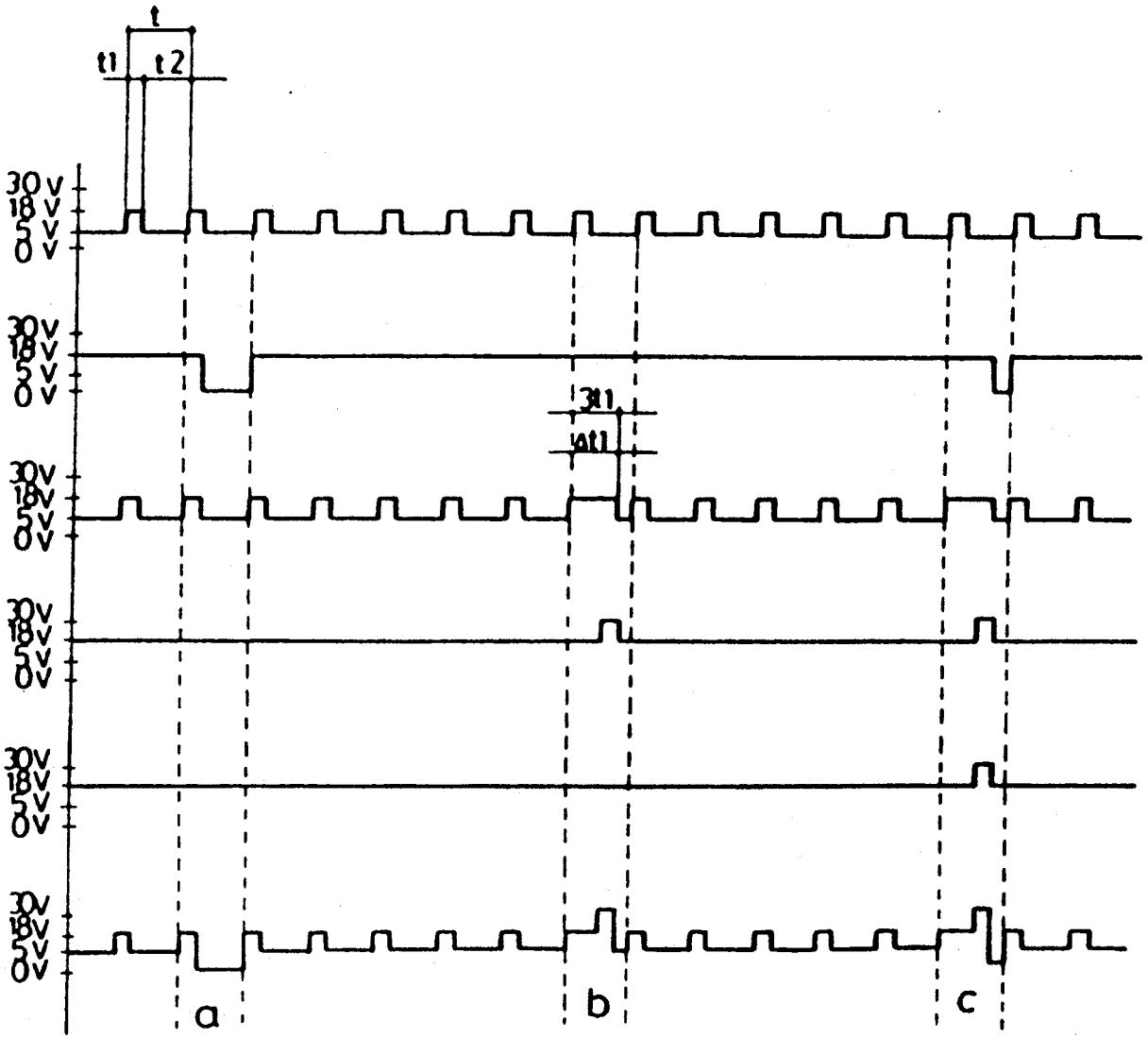
FIGS. 3A to 3K illustrate a number of related signal waveforms in the present invention.

FIG. 3A illustrates the clock signal which has a period t and a duty cycle t1 having a high level of 18 volts and a low level of 5 volts, where t2 is three times t1. FIG. 3B illustrates the data signal, which is outputted from the transistor 152 and has a low level of zero and a high level of 18 volts. A backward signal is set as a high level of 30 volts, as shown in "b" portion of FIG. 3D. The period of the backward signal is set as several times of that of the clock signal (as will be described later). Therefore the clock signal, the forward data signal, the backward data signal, and the forward/backward control signal are mixed in a same line.

Referring to FIG. 4, the clock signal from the output terminals P1.0, P1.2, P1.4, and P1.6 of the microcomputer 11 is adjustable internally by software. The clock signal from output terminal P1.0 and the data signal from P1.1 are combined via driver 15 which has an output waveform at a contact point OUT1 as shown in FIG. 3F. Actually, input selecting means 14 cooperate with software to determine the output statuses of the output terminals P1.0 to P1.7. However, this is well known in the microcomputer field and will not be described in detail herein. FIG. 3A illustrates a clock signal having a cycle t, which merely represents a forward control signal from the main controller 20. Cycle t contains a duty cycle t1 and a non-duty cycle t2, and is determined by input selecting means 4 and software, where the t1 portion is a constant value, while the t2 portion is adjustable. In the present embodiment, t2 is three times t1. Cycle t also represents a shifting time period for a light string, which will be described later.

Referring to FIG. 3B, illustrating the sending of forward data, the driving transistor 152 is actuated to be on; therefore, the waveform is low (zero), thereby indicating that the forward data signal is forward shifted. Referring to FIG. 3C showing the forward/backward control signals sent from the main controller 10. In the "a" portion of FIG. 3C illustrates the forward control signal, the "b" portion the backward control signal, and the "c" portion the forward and backward control signal. The backward control signal is represented by a high-level voltage, with a duty cycle three times t1. The backward control signal actuates the backward data generating circuit 30 and generates the waveform as shown in the "b" and "c" portions of FIG. 3D, indicating that the backward shifting data is shifted backward.

Figure 5:
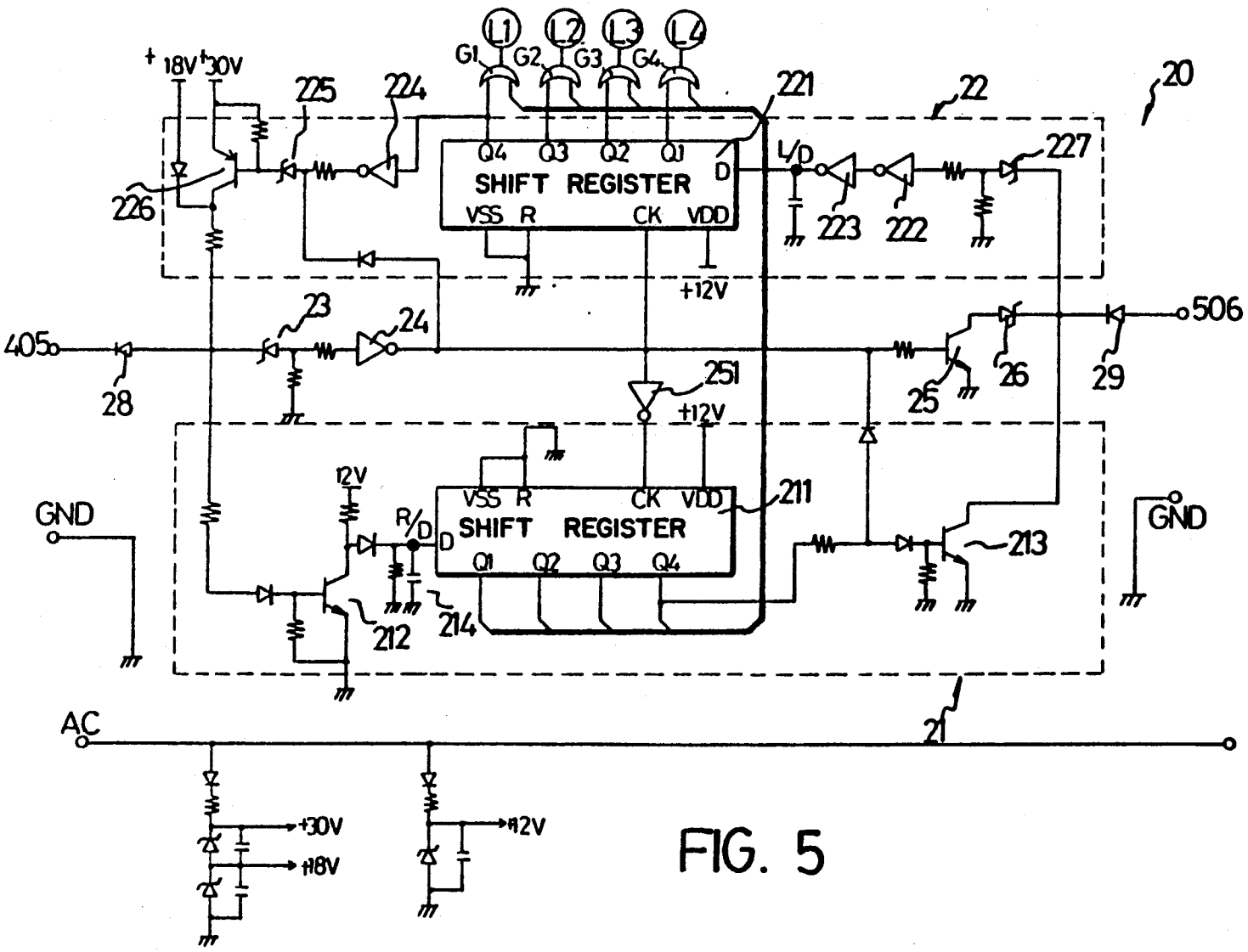
FIG. 5 is a circuit diagram of the bidirectional-shifting control unit.

Referring to FIG. 5, a forward shifting circuit 21, a backward shifting circuit 22, and other components for synchronous control are illustrated. The forward shifting circuit 21 comprises a first shift register 211 which has four output terminals Q1, Q2, Q3, and Q4 connected to four OR gates G1, G2, G3, and G4, respectively. The backward shifting circuit 22 comprises a second shift register 221 which has four output terminals Q4, Q3, Q2, and Q1 connected to the OR gates G1, G2, G3, G4, respectively. OR gages G1, G2, G3, and G4 are connected to lights L1, L2, L3, and L4, respectively. The lights L1 to L4 constitutes a light string on the shifting unit 20. A clock signal having a range of 18 to 5 volts from contact point 405, through a 5-volt Zener diode 23 and an inverter 24, provides required synchronous signals, i.e., forward clock signal (FIG. 3G) and backward clock signal (FIG. 3H) to the forward shifting circuit 21 and the backward shifting circuit 22, respectively.

The forward clock signal is further amplified by a sequentially connected transistor 25, through a 5-volt Zener diode 26, a diode 29 and to next bidirectional-shifting control unit 20. The backward clock signal, as shown in FIG. 3H, is provided to the CK terminal of the second shift register 221, and the forward clock signal, as shown in FIG. 3G, is provided to the CK terminal of first shift register 211.

When the forward data at level zero (portion "a" of FIG. 3B) is inputted, a transistor 212 of the forward shifting circuit 21 is cut off, causing a positive power source (+12 volt) to charge the capacitor 214 and further causing the shift register 211 to have a high input in the data terminal D thereof. The transistor 212 is triggered by the forward clock (FIG. 3G) to enable the data of Q1 to shift forward (shift right) and through OR gate G1 to further drive the light L1. By means of forward clock signal (FIG. 3G), the forward data is shifted forward in the first shift register 211 and enables the light strings therefore to twinkle sequentially from L1 to L4. When the output terminal Q4 is in a high status, a sequentially connected transistor 213 is actuated on to generate a zero-volt data to shift to next shifting unit 20. A last shifting unit 20 is connected to the backward signal generating circuit 30 at contact point 506.

Figures 3G, 3H, 3I, 3J, 3K:
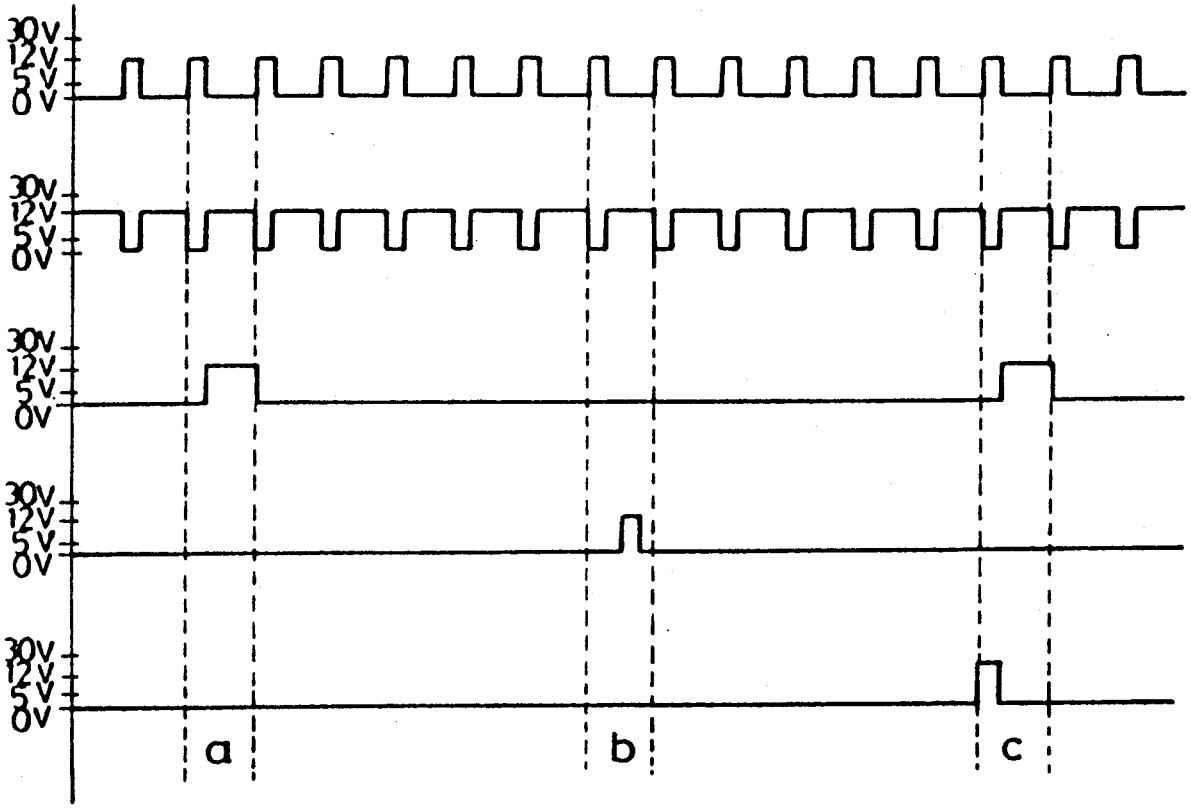

The method of transmitting the backward data (FIG. 3D) is shown in the right side of contact point 506 of FIG. 5, where a 30- to 18-volt, high-level voltage is inputted through a 12-volt Zener diode 227 and inverters 222 and 223 to obtain backward data at input terminal D of the second shift register 221, as shown in FIG. 3J. The backward data as shown in FIG. 3J further enables the second shift register 221 to output a high-level voltage (the waveform is shown in the "b" portion of FIG. 3D) which cooperates with the backward clock signal (FIG. 3H) to shift backward in the second shift register 221, and sequentially output a high-level voltage at Q1 to Q4 thereof and coupled to the OR gates G4, G3, G2, and G1 to further enable the light string to twinkle backward, i.e., from light L4 to L1 sequentially. Similarly, when the Q4 terminal has a high level (see FIG. 3K), the high-level voltage is transmitted through an inverter 224, an 18-volt Zener diode 225, and a transistor 226 to output backward data having a range of 30 to 18 volts in contact point 405 and is transmitted to a previous unit. Since the forward shifting circuit 21 and the backward shifting circuit 22 are independently operated, therefore even when the forward and backward data are simultaneously presented in a same shifting unit, because of the existence of the OR gates G1 to G4, the forward shifting and the backward shifting effect of the twinkling light string are simultaneously accomplished and further show a cross-twinkling effect.

Figure 6:
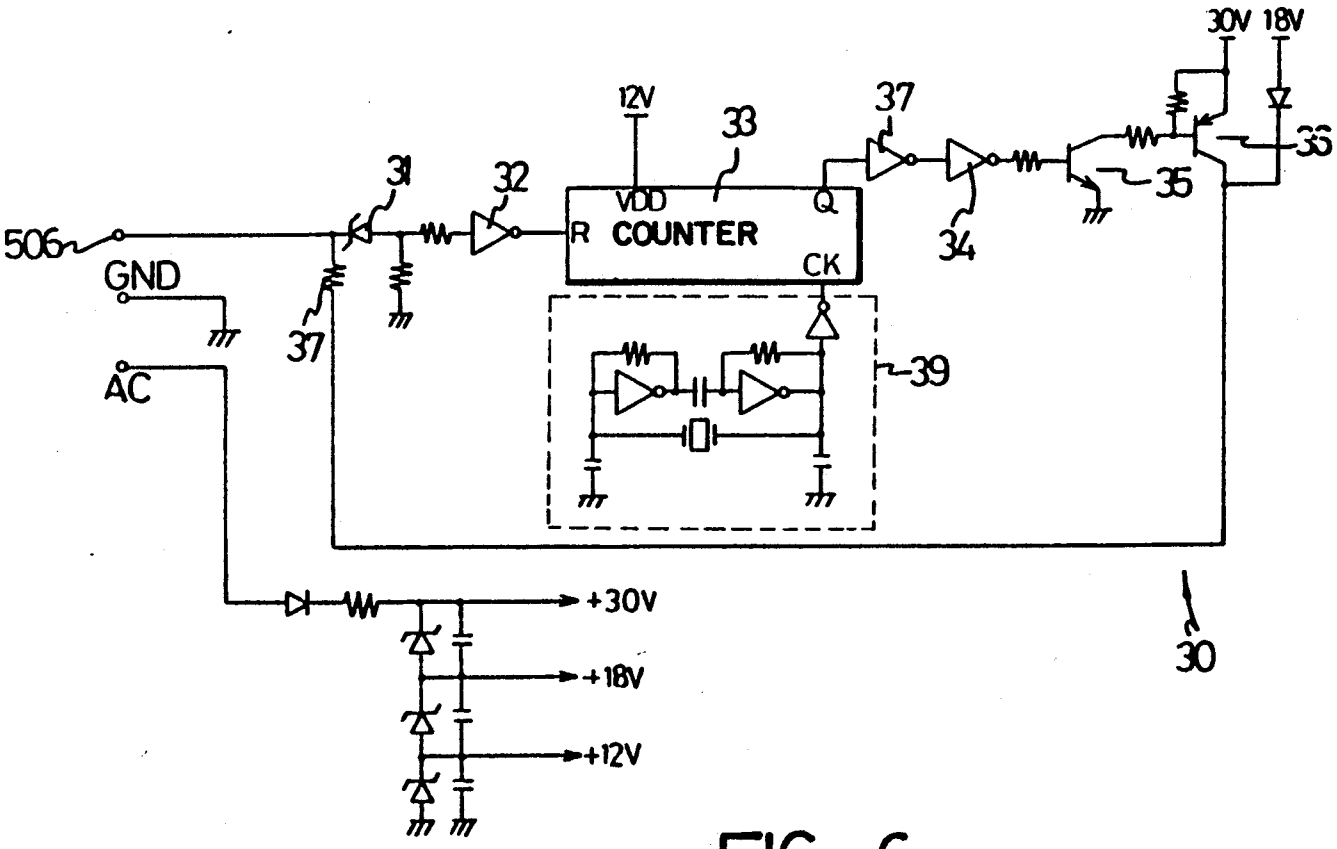
FIG. 6 is a circuit diagram of the backward signal generating circuit.

Referring to FIG. 6, the backward generating circuit 30 comprises a counter 33, a clock generator 39, and a plurality of driving transistors and inverters for receiving and identifying backward control signals (portions "b" and "c" of FIG. 3C) and generating backward data having a 30-volt high-level voltage, as shown in FIG. 3D. The clock generator 39 provides a clock having a cycle of t(t is four times t1) which includes a duty cycle two times t1. When the main controller 10 outputs a forward control signal as shown in portion "a" of FIG. 3C, the output terminal Q of the counter 33 is always in a "low" status, because the duty cycle of the forward control signal is t1. The forward control signal is inputted in the reset terminal R of the counter 33, while the duty cycle of the clock input at the CK terminal is two times t1, thereby causing the counter 33 to stay low and further causing transistor 36 to cut-off, such that a low-level voltage 18-volt is presented at contact point 506 as shown in the "a" portion of FIG. 3D.

Referring to "b" portion of FIG. 3C, the main controller 10 sends out a backward control signal having a duty cycle three times t1 and a high level of 18 volts, to input to the reset terminal R of the counter 33. The backward control signal is a synchronous signal which is in a high level of 18 volts and has a duty cycle of approximately three times t1. Therefore, when a clock having cycle two times t1 is inputted into the counter 33, the backward control signal is divided by 2t1 and terminal Q of the counter 33 outputs a high-level voltage having a duty cycle of t1, which further passes through inverters 37 and 34 and actuates a transistors 35 to be on. Transistor 35 in turn actuates a transistor 36 to operate in saturation, thereby generating a high-level pulse (30 volts) having a duty cycle of t1 to be fed back through a feed-back resistor 37 and to contact point 506 as shown in the "b" portion of FIG. 3D. As described above, the receiving and identifying of the backward control signal (the "b" portion of FIG. 3C) and the generating of the backward data (FIG. 3D) is illustrated. The backward data is shifted backward and causes the lights L1 to L4 of the bidirectional-shifting control unit 20 to twinkle backward.

Figure 7:
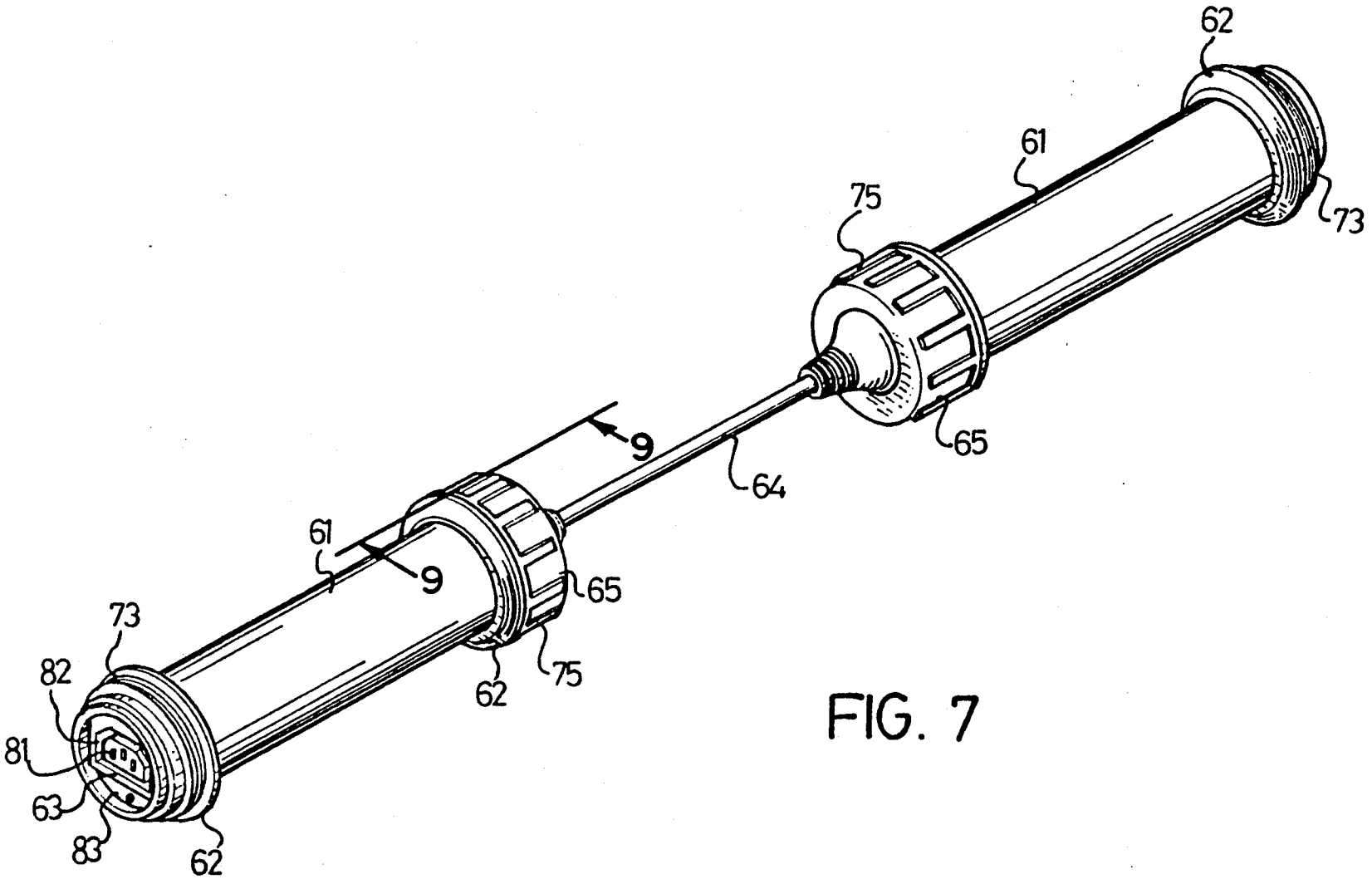
FIG. 7 is a perspective view of a water-proof structure taken from line 9—9 of FIG. 7 of a light string.
Figure 8:
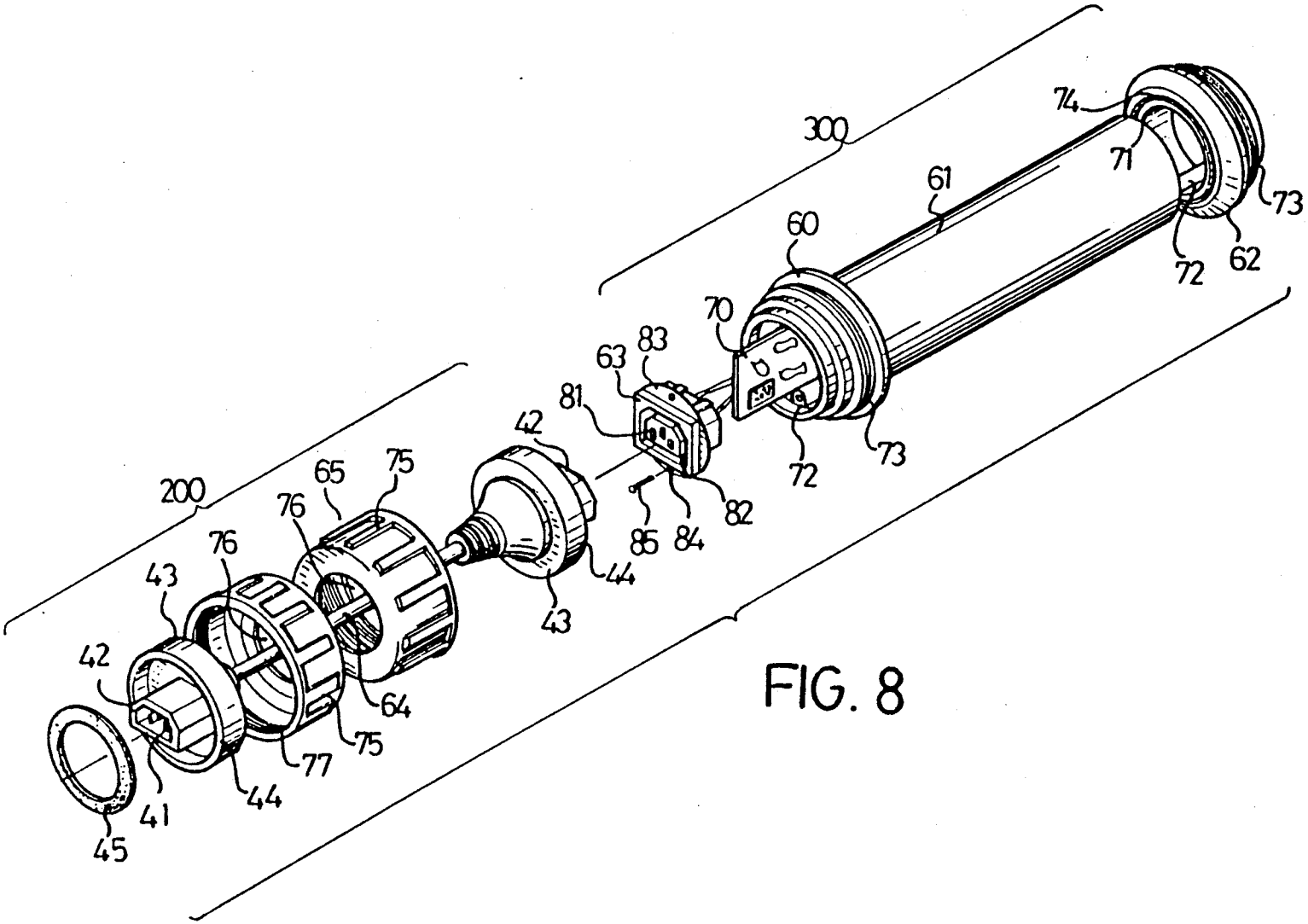
FIG. 8 is an exploded view of the water-proof structure.
Figure 9:
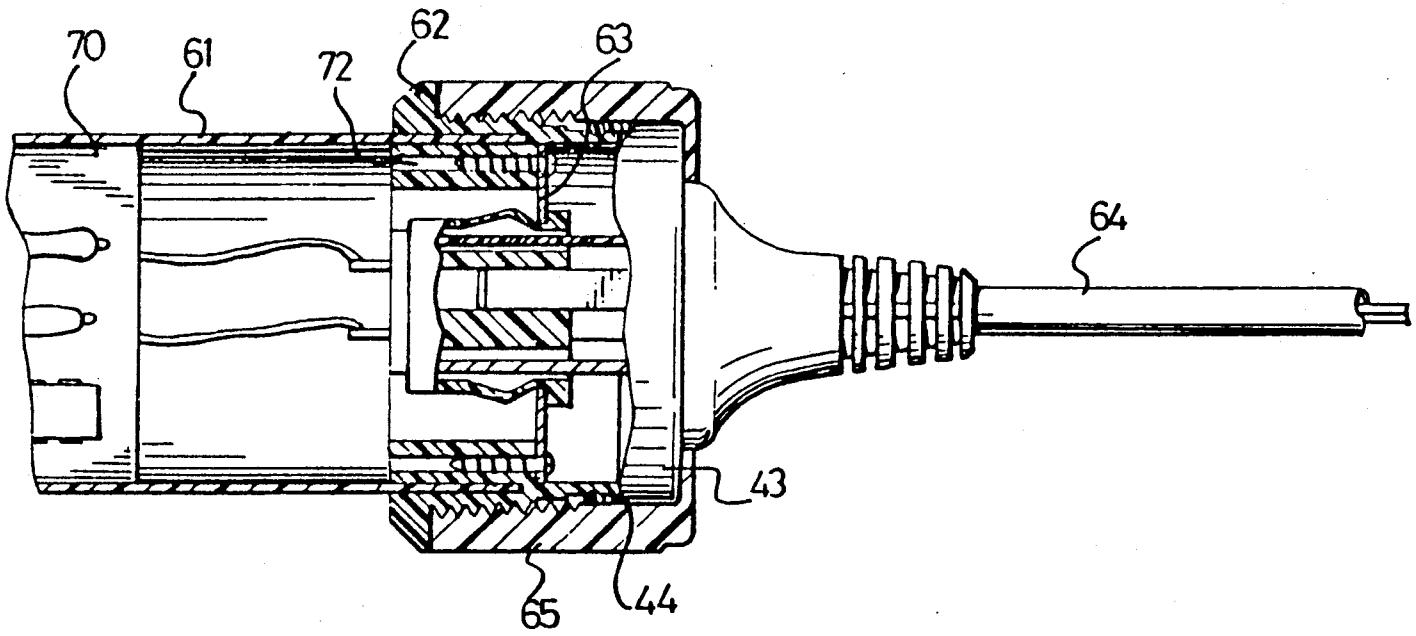
FIG. 9 is a partially cross-sectioned view of the water-proof structure.

The light string has a water-proof structure as disclosed in FIGS. 7 to 9. Referring to FIG. 8, an exploded view is shown of a tube unit 300 and an engaging unit 200, both of which are coupled alternately, thereby constituting an extendible light string. The tube unit 300 comprises a tube means 61 for receiving a PC board 70, two socket receiving means 62 being engaged in two sides thereof, and two socket means 63 being engaged to the socket receiving means 62. The PC board 70 is used to locate the circuit and a set of light strings. The socket receiving means 62 has a groove portion 74 in one side thereof for receiving the tube means 61, a screw receiving portion 72 protruding in the inner portion thereof, and a screw portion 73 in the other side thereof. The socket means 63 comprises triple sockets 81, a disk portion 83, and a recess portion 82 around the triple sockets 81. A hole is formed in the disk portion 83 for engaging with the screw receiving portion 72 by a bolt 85.

The engaging unit 200 comprises a cord 64 which has three lines (two power lines, one signal line), two triple-plugs 41 connected to two ends thereof, two shell portions 42 respectively enclosing the triple-plugs 41, two water-proof portions 43 each of which having a flange portion 44 in one end thereof, two gaskets 45 respectively attached to the inside parts of the water-proof portion 43, and two securing means 65 each of which having a hole 76 with threads 77 therein and has protruding bars 75 for easily manual controlling.

The assembly of FIG. 8 is shown in FIGS. 7 and 9. When assembled, the triple-plug is inserted into the triple-socket, the shell portion 42 is engaged into the recess portion 82, the securing cover 65 is manually turned into the socket receiving means 62, the threads 77 inside the securing cover 65 are matched to the screw portion 73 on the socket receiving means 62, the water-proof cover 43 is forced to attach to the flange portion 78 of the socket receiving means 62 by the flange portion 44 thereof, and the gasket 45 totally contacts the outer part of the socket receiving means 62. Therefore, the engagement between the engaging unit 200 and the tube unit 300 is water-proof effect.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A sequentially shifting control circuit for extendible light strings comprising a main controller serially coupled with a plurality of bidirectional-shifting control units and a backward signal generating circuit, a single signal line and two power lines coupling said main controller, said bidirectional-shifting control units, and said backward signal generating circuit; synchronous signals for said control circuit having a level between 18 volts and 5 volts, forward data signals and backward data signals being synchronously interposed in a low level between zero and 5 volts and a high level between 18 volts and 30 volts, respectively, backward control signals being interposed in the synchronous signal and having a duty cycle greater than said synchronous signal, such that said signal line transmits said synchronous signal, said forward data signal, said backward data signal, and said backward control signal simultaneously;

wherein said main controller comprises a microcomputer, a synchronous signal generator, a data signal generator, a plurality of selection switches, and a plurality of drivers, said synchronous signal generator, said data signal generator and said microcomputer cooperating to generate said synchronous signal having a duty cycle and said data signals having the same period but different duty cycles.

2. A shifting control circuit as claimed in claim 1, wherein said driver comprises two transistors, each of which is coupled to a clock and data output terminal of said microcomputer, respectively, said two transistors being coupled together at collectors thereof.

3. A shifting control circuit as claimed in claim 1, wherein said bidirectional-shifting control unit comprises two independent shift circuits, each of which comprises a shift register, said two registers having a plurality of output terminals, a corresponding terminal from each register forming a pair, each pair being connected to an OR gate which is further connected to a light, thereby constituting a light string, said two shift registers having data input terminals thereof and driving output terminals thereof being inverted to connect to two external terminals to function forward and backward respectively, said synchronous control circuit receiving said synchronous signal from one of said external terminals and connecting to said two shift registers at a clock terminal thereof, and through a transistor circuit to regenerate synchronous signals to couple to the other external terminal and transmit to the next shifting control unit.

4. A shifting control circuit as claimed in claim 1, wherein said backward signal generating circuit comprises a counter for frequency dividing, a second clock generator for providing a clock having a duty cycle, and a driving transistor, said counter having a reset terminal connected to output of said driving transistor, such that when said counter receives a signal having a duty cycle which is greater than that of said clock, a high level pulse is fed back to the same reset terminal.

5. A sequentially shifting control circuit for extendible light strings comprising a main controller serially coupled with a plurality of bidirectional-shifting control units and a backward signal generating circuit, a single signal line and two power lines coupling said main controller, said bidirectional-shifting control units, and said backward signal generating circuit; synchronous signals for said control circuit having a level between 18 volts and 5 volts, forward data signals and backward data signals being synchronously interposed in a low level between zero and 5 volts and a high level between 18 volts and 30 volts, respectively, backward control signals being interposed in the synchronous signal and having a duty cycle greater than said synchronous signal, such that said signal line transmits said synchronous signal, said forward data signal, said backward data signal, and said backward control signal simultaneously;

wherein said bidirectional-shifting control unit comprises two independent shift circuits, each of which comprises a shift register, said two registers having a plurality of output terminals, a corresponding terminal from each register forming a pair, each pair being connected to an OR gate which is further connected to a light, thereby constituting a light string, said two shift registers having data input terminals thereof and driving output terminals thereof being inverted to connect to two external terminals to function forward and backward respectively, said synchronous control circuit receiving said synchronous signal from one of said external terminals and connecting to said two shift registers at a clock terminal thereof, and through a transistor circuit to regenerate synchronous signals to couple to the other external terminal and transmit to the next shifting control unit.

6. A sequentially shifting control circuit for extendible light strings comprising a main controller serially coupled with a plurality of bidirectional-shifting control units and a backward signal generating circuit, a single signal line and two power lines coupling said main controller, said bidirectional-shifting control units, and said backward signal generating circuit; synchronous signals for said control circuit having a level between 18 volts and 5 volts, forward data signals and backward data signals being synchronously interposed in a low level between zero and 5 volts and a high level between 18 volts and 30 volts, respectively, backward control signals being interposed in the synchronous signal and having a duty cycle greater than said synchronous signal, such that said signal line transmits said synchronous signal, said forward data signal, said backward data signal, and said backward control signal simultaneously;

wherein said backward signal generating circuit comprises a counter for frequency dividing, a second clock generator for providing a clock having a duty cycle, and a driving transistor, said counter having a reset terminal connected to output of said driving transistor, such that when said counter receives a signal having a duty cycle which is greater than that of said clock, a high level pulse is fed back to the same reset terminal.

* * * * *